US006135073A

United States Patent [19]

Feucht et al.

[11] Patent Number: 6,135,073

[45] Date of Patent: Oct. 24, 2000

[54] HYDRAULIC CHECK VALVE RECUPERATION

[75] Inventors: Dennis D. Feucht, Morton; Steven J. Funke, Princeville, both of Ill.

[73] Assignee: Caterpillar Inc., Peoria, Ill.

[21] Appl. No.: 09/298,275

[22] Filed: Apr. 23, 1999

[51] Int. Cl.[7] ..... F01L 9/02

[52] U.S. Cl. ..... 123/90.12; 123/90.49

[58] Field of Search ..... 123/90.12, 90.13, 123/90.15, 90.48, 90.49

[56] References Cited

U.S. PATENT DOCUMENTS

| | | | |
|---|---|---|---|
| 1,930,553 | 10/1933 | Hallett | 123/90 |
| 2,101,221 | 12/1937 | L'Orange | 103/41 |
| 2,582,535 | 1/1952 | Drouot | 103/2 |
| 2,633,082 | 3/1953 | McFarland | 103/37 |
| 2,686,476 | 8/1954 | Klein et al. | 103/2 |
| 3,699,939 | 10/1972 | Eckert et al. | 123/140 J |
| 4,000,756 | 1/1977 | Ule et al. | 137/596.17 |
| 5,019,119 | 5/1991 | Hare, Sr. | 123/500 |
| 5,070,848 | 12/1991 | Mitsuyasu | 123/506 |
| 5,135,367 | 8/1992 | Finsterwalder | 417/495 |
| 5,165,875 | 11/1992 | Lebret | 417/495 |
| 5,221,072 | 6/1993 | Erickson et al. | 251/30.05 |
| 5,237,976 | 8/1993 | Lawrence et al. | 123/508 |
| 5,263,441 | 11/1993 | Rembold et al. | 123/90.12 |
| 5,275,136 | 1/1994 | Schechter et al. | 123/90.12 |
| 5,410,994 | 5/1995 | Schechter | 123/90.12 |
| 5,456,221 | 10/1995 | Schechter | 123/90.12 |
| 5,456,222 | 10/1995 | Schechter | 123/90.12 |
| 5,456,223 | 10/1995 | Miller et al. | 123/90.12 |
| 5,492,098 | 2/1996 | Hafner et al. | 123/446 |
| 5,531,192 | 7/1996 | Feucht et al. | 123/90.12 |
| 5,540,206 | 7/1996 | Heimberg | 123/497 |
| 5,562,070 | 10/1996 | Schechter et al. | 123/90.12 |
| 5,577,468 | 11/1996 | Weber | 123/90.12 |
| 6,067,946 | 5/2000 | Bunker et al. | 123/90.12 |

*Primary Examiner*—Weilun Lo
*Attorney, Agent, or Firm*—Stephen J. Church; Larry G. Cain

[57] ABSTRACT

An hydraulic actuator for a spring closed poppet valve is connected to an electrically motivated valve selecting a high or a low fluid pressure source for a chamber in which a plunger reciprocates in a cylindrical body. Poppet valve closing is controlled by restricting fluid flow from the chamber to the low pressure source. Initially, closing flow is through a closing check valve and is gradually cut off by a frusto-conical end of the plunger. Closing flow is then restricted by an orifice bypassed by a snubber check valve during poppet valve opening. The closing check valve, an opening port, and a recuperation check valve open radially through the body. The closing check valve and the opening port communicate with an annular body groove connected to the electrically motivated valve. The recuperation check valve communicates with the plunger chamber beyond the plunger end and opens directly to the high pressure source when the closing kinetic energy of the actuator elements and poppet valve develops an even higher pressure due to the restricted closing flow. Some of this energy is thus recuperated for poppet valve opening.

4 Claims, 3 Drawing Sheets

HYDRAULIC CHECK VALVE RECUPERATION

TECHNICAL FIELD

The present invention relates generally to a hydraulic actuator for an internal combustion engine poppet valve and, more particularly, to such an actuator having a check valve for recuperating, as hydraulic energy, closing kinetic energy of the actuator and valve.

BACKGROUND OF THE INVENTION

It is known, as in U.S. Pat. No. 5,531,192 which issued Jul. 8, 1996, to provide a spring closed poppet valve with an hydraulic actuator connected to an electrically motivated valve selecting a high or a low fluid pressure source for a cylindrical plunger chamber which extends through a cylindrical body and in which a plunger reciprocates. This actuator controls poppet valve closing by restricting fluid flow from the plunger chamber to the low pressure source. At final valve closing, this flow is restricted by an orifice, which is bypassed by a first check valve during poppet valve opening, after initially restricting the closing flow through a second check valve to which flow is gradually cut off by a frusto-conical end of the plunger. In this actuator, opening ports and the second check valve open radially through the body, and the orifice and the first check valve are disposed in the plunger centrally of its frusto-conical end and communicate with the closing check valve through an annular chamber about the plunger. The second check valve and opening ports communicate with an annular body chamber connected to the electrically motivated valve, and the opening ports are disposed to communicate with the annular plunger chamber when the poppet valve is closed. On poppet valve opening, The second check restricts fluid flow to the opening ports.

It is also known, as in U.S. Pat. No. 5,562,070 which issued Oct. 8, 1996, to provide such an actuator for a unitary poppet valve and piston, where the valve is both opened and closed by fluid forces, with a check valve which opens for fluid to be pushed from a volume above the piston into a high pressure source during valve seating to avoid the possibility of hard impact during valve seating.

It is thus evident that, in the actuators disclosed by these patents, the various check valve and fluid communication arrangements serve to control poppet valve closing speed and impact rather than to recuperate the kinetic energy of the poppet valve and actuator elements moving therewith during closing and thus reduce the power required to operate poppet valves.

SUMMARY OF THE INVENTION

In one aspect of the present invention, a recuperation valve is provided for an internal combustion engine hydraulic poppet valve actuator in which the closing kinetic energy of the poppet valve and moving elements of the actuator develops, in a plunger chamber of the actuator, a pressure greater than that in a high pressure fluid source for motivating the poppet valve and the moving actuator elements to an open position of the poppet valve. The recuperation valve connects the chamber and the source when the pressure is higher in the chamber than in the source so as to capture some of the kinetic energy as hydraulic energy for poppet valve opening.

In another aspect of the invention, the poppet valve is opened and closed, respectively, by connecting the plunger chamber to the high pressure fluid source and to a low pressure fluid source, and the closing velocity of the poppet valve and the moving actuator elements is controlled by restricting fluid flow from the plunger chamber to the low pressure source so that the above-mentioned pressure greater than that in the high pressure fluid source develops in the plunger chamber. The poppet valve and actuator elements may be motivated for closing by a spring, and the recuperation valve may be a check valve.

In a further aspect of the invention, the actuator has a plunger reciprocating in the plunger chamber and extending through a cylindrical body toward the poppet valve. Initially, fluid flow on closing the poppet valve is primarily through a closing check valve and is gradually cut off by a frusto-conical end of the plunger. The closing fluid flow is then restricted by an orifice bypassed on poppet valve opening by a snubber check valve. This orifice and the snubber check valve are disposed in the plunger centrally of its frusto-conical end and, for opening and snubbing fluid flow, communicate with an annular groove disposed exteriorly of the plunger.

The recuperation check valve communicates with the plunger chamber at a point which is axially beyond the frusto-conical plunger end when the poppet valve is closed. The recuperation and closing check valves are individually disposed in a pair of recesses extending radially through the body from a pair of corresponding annular grooves about the body. The annular groove corresponding to the recuperation check valve is connected directly to the high pressure source, and the annular cavity corresponding to the closing check valve is connected to an electrically motivated valve for selecting the high or the low pressure source. An opening port extends radially through the body from the latter annular cavity and is disposed to communicate with the annular plunger groove when the poppet valve is closed. On poppet valve opening, the closing check valve closes so that fluid can only flow to the plunger chamber though the opening port.

DETAILED DESCRIPTION OF THE INVENTION

Figure 1:
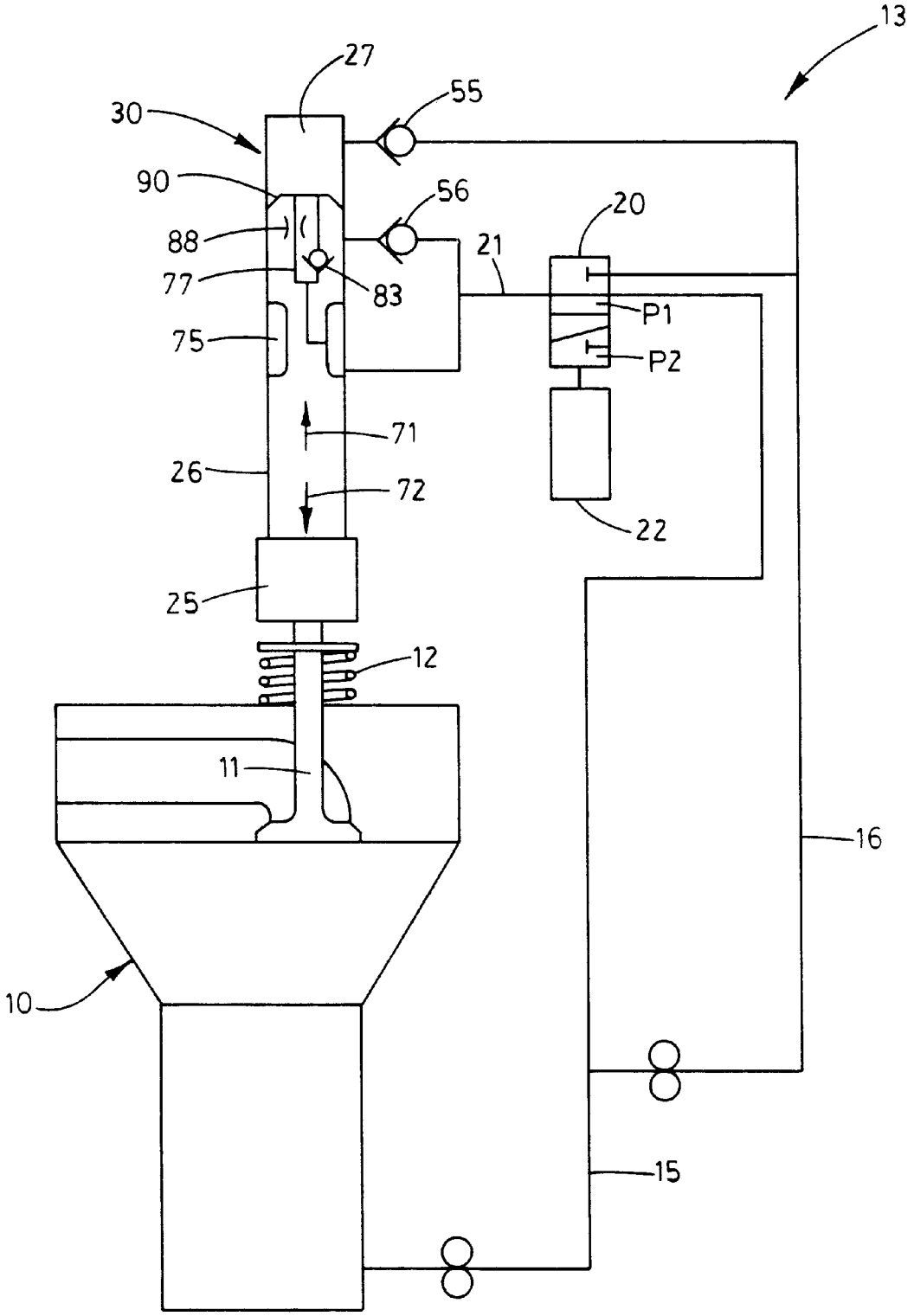
FIG. 1 is a diagram of an internal combustion engine with an hydraulic valve actuating system embodying the principles of the present invention for recuperation by a check valve.

In FIG. 1 there is represented an internal combustion engine, indicated generally by numeral 10, having a poppet valve 11 closed by a spring 12 and having an hydraulic valve actuation system indicated generally by numeral 13. System 13 actuates the poppet valve to move in a closing direction, which is upward in FIGS. 1 and 2, to the depicted closed position and in an opposite opening direction to the usual open position, not shown. System 13 has a low pressure actuating fluid source 15, which is represented as a conduit line pressurized by a pump from a lubricating oil sump of the engine, and has a high pressure actuating fluid source 16 represented as another conduit line further pressurized from the low pressure source. The elements so far described may be of conventional construction and need not be further described except to mention that the low pressure source typically provides a pressure of less than 200 to 400 psi and the high pressure source typically provides a pressure of 1500 to 5000 psi.

System 13 has a valve 20 connected to sources 15 and 16. Valve 20 has a fluid connection 21 switched between these sources by any suitable device 22 which, typically, is electrically motivated and electronically controlled to select the opening and closing times of valve 11. Connection 21 is thus a dual pressure source of actuating fluid. Valve 20 is represented in a closing position P1 in which connection 21 is connected to low pressure source 15 for positioning poppet valve 11 in its depicted closed position. Valve 20 also has an opening position P2 in which connection 21 is connected to high pressure source 16 for positioning the poppet valve in its open position. Valve 20 and its operation may be conventional and also need not be further described.

As shown in FIG. 1, hydraulic valve actuation system 13 has various elements of generally circular construction positioned above poppet valve 11 and coaxial with a desired axis of poppet valve movement. The system 13 elements include a tappet 25 and a plunger 26 which reciprocates in a plunger chamber 27 as an actuator element for a valve element, specifically the poppet valve. Elements 25 and 26 are schematically represented in FIG. 1 and are shown in greater detail in FIG. 2 where they are mounted in any suitable element 28 such as a cylinder head or a poppet valve actuator head. Tappet 25 may be provided with hydraulic lash adjustment arrangements pressurized from low pressure source 15, these arrangements may also be conventional and are thus not depicted.

Numeral 30 in FIG. 1 indicates generally a hydraulic actuator embodying the principles of the present invention for actuating poppet valve 11. The actuator is shown in detail in FIG. 2 and includes elements 25 and 26 and other elements schematically represented in FIG. 1. The actuator has a cylindrical body 31 fixedly received in a bore 33 of head 28 adjacent to a high pressure rail or conduit 35 and to a dual pressure conduit 36, these conduits being directly connected, respectively and as represented in FIG. 1, to source 16 and to connection 21 of valve 20. Typically, valve 20 is associated with and controls the timing of the one poppet valve 11 while conduit 35 provides high pressure actuating fluid to a plurality of poppet valves which may be associated with other cylinders than that associated with the one poppet valve. Hydraulic energy, which is recuperated in accordance with the present invention as subsequently described, is thus available for poppet valves of such other cylinders.

Body 31 has a cylindrical exterior surface 40 and has a central bore 41 defining a cylindrical inner surface of the body and receiving plunger 26 for axial movement therein. The body has an axial end 42 disposed at tappet 25, this end being open for movement of the plunger axially therefrom into engagement with tappet 25 which moves with poppet valve 11. The body has an opposite axial end 43 which, as indicated by numeral 45, is provided with any suitable plug arrangement which closes bores 33 and 41. The body has two annular grooves 47 and 48 disposed in surface 40. Axially of the body, groove 47 is adjacent to plug 45 while groove 48 is centrally disposed. Groove 47 is directly connected to high pressure conduit 35, and groove 48 is directly connected to dual pressure conduit 36.

Body 31 has a recuperation passage 50, a closing passage 51, and an opening passage 52 extending radially through the body between its surfaces 40 and 41. The recuperation passage is disposed at annular groove 47 and defines a recuperation location which, axially of bore 41, is disposed between plug 45 and plunger 26 when the plunger is in its depicted position corresponding to the closed position of poppet valve 11. Closing passage 51 is disposed at the end of groove 48 that is toward groove 47. The closing passage is thus spaced from the recuperation passage toward the body end 42 at which plunger 26 is shown engaged with tappet 25. Opening passage 52 is disposed at the end of groove 48 opposite groove 47 so that the opening passage is spaced from the closing passage toward body end 42. It is evident that, at the exterior surface 40 of body 31, groove 48 provides dual pressure conduit 36 with fluid communication to passages 51 and 52.

Figure 2:
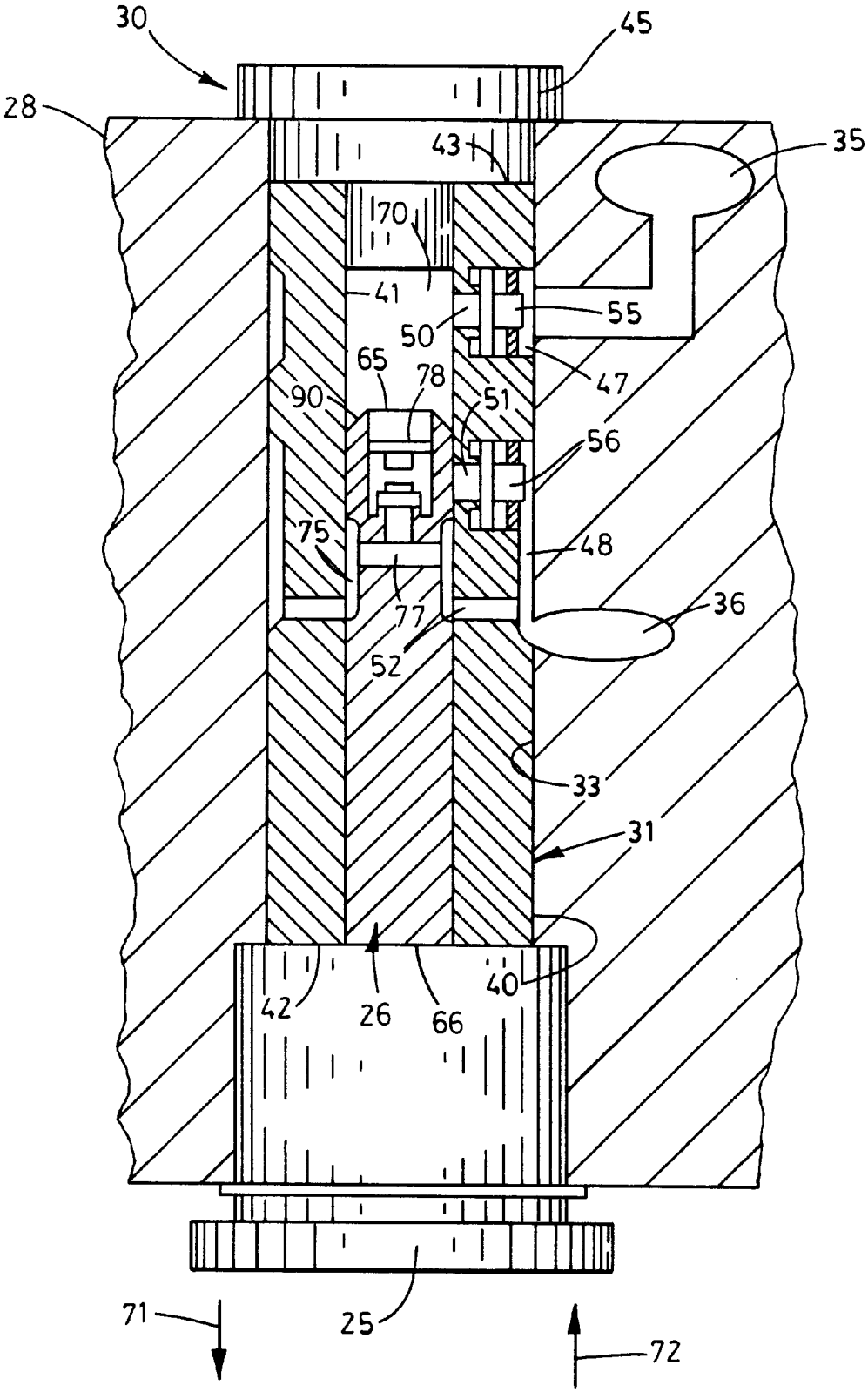
FIG. 2 is a somewhat diagrammatic axial section of an actuator which is applicable to the valve actuating system of FIG. 1 and which includes such a check valve for hydraulic recuperation.

As best shown in FIG. 2, a recuperation check valve 55 is disposed in passage 50, and a closing check valve 56 is disposed in passage 51, these check valves being represented schematically in FIG. 1. Check valves 55 and 56 block actuating fluid flow radially inwardly of body 31 through the corresponding passages 50 and 51 and pass such flow radially outwardly of the body through these passages. These check valves may have any suitable construction such as the substantially identical construction somewhat simplified in FIG. 2 and shown in greater detail in FIG. 3 for check valve 56.

Valve 56 has a seat 60 formed in body 31 and a moving disk 61 depicted in a seated position to which the disk is urged by a coil spring 62 omitted in FIG. 2 for illustrative convenience. The moving disk has a unitary stem extended through a fixed disk 63. When fluid pressure in central bore 41 is greater than that in annular groove 48—or groove 47 for valve 55 —the moving disk is unseated and fluid flows from this bore through suitable openings in the disks, the openings in the moving disk being omitted for illustrative convenience.

It is evident that, in the case of recuperation check valve 55 such moving disk is unseated during a condition when fluid pressure in central bore 41 at passage 50 is greater than that in the high pressure source 16. It is apparent from the Figures that, during this condition, valve 55 opens fluid communication from within bore 41 to conduit 35 and thus to source 16 since valve 55 has direct fluid connection to this bore and to this source. This condition will be subsequently discussed in greater detail and is generated by the closing kinetic energy of poppet valve 11, tappet 25, and plunger 26 with at least some of this kinetic energy being recuperated to conduit 35 through check valve 55 in accordance with the principles of the present invention.

Referring in greater detail to plunger 26, the plunger is disposed in central bore 41 of body 31 for substantially fluid tight and axially slidable movement. The plunger has an axial end or end surface 65 which is disposed in the body, is spaced axially from plug 45, and extends transversely of the central bore. The plunger has an opposite axial end 66 disposed toward and engaged with tappet 25, end 66 being axially extendable from the body to drive the tappet toward poppet valve 11.

It is apparent that plunger end surface 65 together with plug 45 and the interior surface of central bore 41 define a chamber 70 having therein a corresponding quantity of actuating fluid. This chamber has direct fluid communication with recuperation check valve 55 through passage 50 and varies in volume as plunger 26 reciprocates in the central bore. It is also apparent that plunger 26, which bears surface 65, is operatively connected to the poppet valve 11 by way of tappet 25. It is further apparent that the central bore mounts the plunger for axial movement in one direction 71 toward plunger end 66 and in an opposite direction 72 toward the plunger end surface 65. The plunger thus moves in direction 71 to open the poppet valve and moves in direction 72 when the poppet valve closes.

Plunger 26 has an annular groove 75 which is disposed axially thereon so that, when the plunger is in the depicted position corresponding to the closed position of poppet valve 11, groove 75 extends, as shown in FIG. 2, from below closing passage 51 across opening passage 52. Groove 75 is thus in fluid communication with the opening passage at the surface of central bore 41. Plunger 26 has a plunger conduit or passages, which are indicated generally by numeral 77, providing fluid communication between plunger end 65 and annular groove 75 and thus between this plunger end and conduit 36. Passages 77 are provided with restriction and check valve elements indicated generally by numeral 78.

Figure 3:
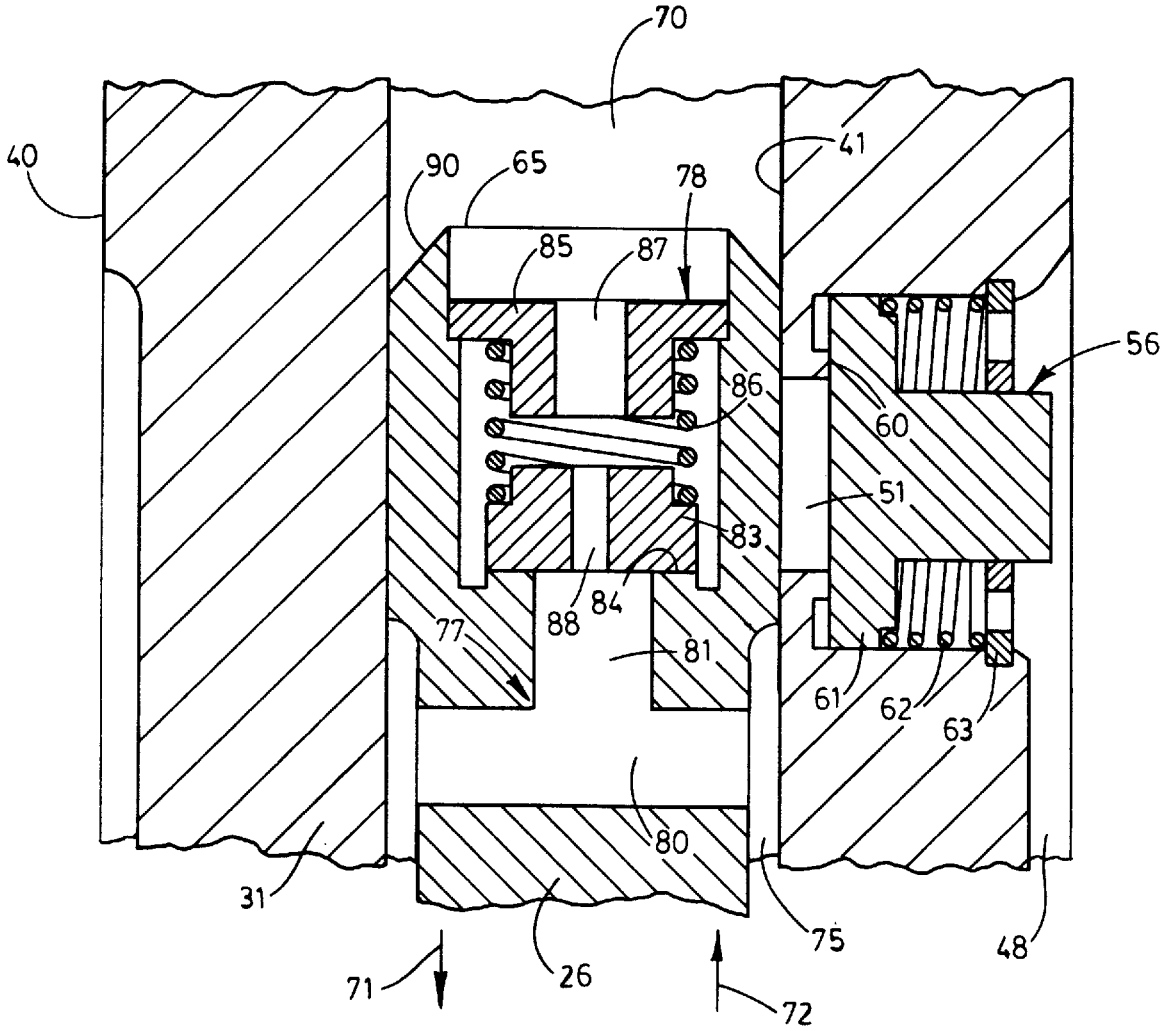
FIG. 3 is a portion of FIG. 2 at a larger scale to show a plunger end and two check valves of the actuator.

Passages 77 and elements 78 will now be described with particular reference to FIG. 3 where it is seen that they include a bore 80 extending transversely of plunger 26 and opening into its annular groove 75 and include a central bore 81 extending from the transverse bore through plunger axial end 65. Bore 81 receives a snubber check valve 83 which moves axially of the plunger and, as best shown in FIG. 3, seats axially against a seat 84 formed in the plunger. A stop 85 is fixedly received in bore 81 and is spaced from valve 83 somewhat toward plunger end 65 when this valve is seated. A coil spring 86, which is omitted for illustrative convenience in FIG. 2, extends between the stop and valve to urge the valve into its seated position. When the valve is in its open or unseated position, actuating fluid can flow in a direction from annular groove 75 toward plunger end 65 with relatively little restriction past seat 84 and through peripheral openings in stop 85, these openings being omitted for illustrative convenience. The stop and the valve are provided with respective bores or orifices 87 and 88 extending through them axially, the latter orifice being smaller in diameter.

When actuating fluid flows through passages 77 in a direction from plunger end 65 toward annular groove 75, this flow and spring 86 cause valve 83 to seat so that flow in this direction through passages 77 is restricted by orifice 88 to a greater extent than flow in the opposite direction through these passages is restricted. It can be seen from FIG. 2 that orifice 88 thus restricts fluid flow from chamber 70 toward conduit 36 by way of passage 52.

Plunger end 65 has a frusto-conical restrictor portion 90. When poppet valve 11 is open, this portion is disposed oppositely of closing passage 51 from plug 45 so that, when the poppet valve subsequently begins to close, the flow of the quantity of actuating fluid in chamber 70 into the closing passage and through closing check valve 56 is unrestricted by this restrictor portion—and also by the above described orifice 88 which is bypassed by the closing passage. However as the valve closes and the plunger moves in direction 72, the frusto-conical portion increasingly restricts this fluid flow and finally shuts it off so that the final closing flow is that described above through orifice 88, annular plunger groove 75, and passage 52.

It is noted at this point that passage 52 is termed "opening passage" although passing this final closing flow because, due to closing check valve 56 blocking passage 51 during high pressure fluid flow to chamber 70 to open the poppet valve, all of this opening flow is through passage 52. By having passages 51 and 52 in parallel with only passage 52 being utilized on poppet valve opening, differing and varying flow restrictions may be provided on poppet valve closing and opening, a feature which is not essential to the present invention but with which it may be used.

Operation

The operation of hydraulic valve actuation system 13 to open and close poppet valve 11 with hydraulic check valve recuperation of closing kinetic energy of the valve will now be described.

With the valve and various elements of the system in their position depicted in the Figures wherein poppet valve 11 is closed, switching valve 20 is actuated to connect dual pressure conduit 36 to high pressure source 16. Actuating fluid then flows from this conduit through annular body groove 48, opening passage 52, annular plunger groove 75, and plunger passages 77 to chamber 70 where the high pressure acts on plunger end 65 driving plunger 26 in opening direction 71 and against tappet 25 so that the tappet engages the poppet valve and opens it while compressing spring 12. As this occurs, closing check valve 56 blocks flow of the actuating fluid flow through the closing passage, and snubber check valve 83 opens bypassing orifice 88 so that the opening flow is not restricted thereby.

When poppet valve 11 is to be closed, switching valve 20 is actuated to connect dual pressure conduit 36 to low pressure source 15. The higher pressure in chamber 70—which is provided directly by the resilient energy of spring and then by the kinetic energy of the poppet valve, tappet 25, and plunger 26—causes the quantity of actuating fluid in chamber 70 to flow therefrom so that the plunger moves in direction 72 and the actuator 30 permits the poppet valve to close.

As before stated, this flow is, initially and primarily, to annular body groove 48 and conduit 36 through closing passage 51 since closing check valve 56 is unseated and is without restriction by the frusto-conical plunger portion 90. As this portion passes the closing passage, however, the closing flow is progressively restricted so that the closing flow is only through plunger passages 77, annular plunger groove 75, and body passage 52 to the body groove with the closing flow being restricted by orifice 88 due to the closing of snubber check valve 83.

As poppet valve 11 closes the restrictions imposed on the closing fluid flow—progressively by plunger portion 90 and then by orifice 88—result in the before mentioned kinetic energy of the moving elements generating a pressure in the chamber 70 that is not only higher than that in the low pressure source 15, but is higher than that provided to conduit 35 by high pressure source 16.

In an hydraulic poppet valve actuator which is similar to actuator 30, but lacks recuperation elements corresponding to passage 50 and check valve 55 of the present invention, this kinetic energy is dissipated at the restricting elements. In actuator 30, however, the higher pressure in chamber 70 urges the recuperation check valve to open for fluid flow radially outwardly of body 31 through the recuperation passage directly to the high pressure conduit 35 so that at least some of the kinetic energy is recuperated to the high pressure source for poppet valve opening. It is apparent that recuperation check valve 55 is closed so long as the pressure in chamber 70 is no more than that in the high pressure conduit. As a result, this check valve does not otherwise effect the closing of this poppet valve 11 or affect the opening thereof except as the check valve may have provided such recuperation.

It is apparent that recuperation in accordance with the present invention occurs in actuator 30 when check valve 55 opens communication to high pressure conduit 35 from within central bore 41 at a regeneration location, which is defined by recuperation passage 55 and thus disposed axially along this bore between plug 45 and plunger end 65, when fluid pressure at this location is greater than fluid pressure in the high pressure conduit.

In a particular engine 10 embodying the present invention, the amount of recuperation may be increased by omitting a frusto-conical plunger region, which corresponds to portion 90 of plunger 26, so that kinetic energy is not dissipated at this region. This modification may be combined with varying the point in movement of a plunger, which corresponds to plunger 26, at which the plunger closes a passage, which corresponds to passage 51 and likewise has a closing check valve, so that more actuating fluid can flow into a conduit corresponding to conduit 35. The amount of recuperation may also be increased by decreasing the size of the orifice corresponding to orifice 88 so that less fluid can escape through this orifice while such a closing check valve is open.

Computer simulations indicate that use of the present invention can recuperate about 10 percent of the energy required for operation of an exhaust poppet valve corresponding to valve 11.

Although the present invention has been described in connection with what is conceived to be a practical and preferred embodiment, it is recognized that departures may be made therefrom within the scope of the invention, which is not limited to the illustrative details disclosed.

What is claimed is:

1. A hydraulic valve actuator for a poppet valve operatively associated with a high pressure fluid source and with a dual pressure source that is selectively connectable to the high pressure fluid source and to a low pressure fluid source, the actuator comprising:

a high pressure conduit connected to the high pressure source;

a dual pressure conduit connected to the dual pressure source;

a body having a cylindrical interior surface, a generally cylindrical exterior surface and axially opposite ends;

plug means for closing one of said axially opposite ends;

a plunger disposed within said interior surface for movement axially of said interior surface, the plunger having one axial end disposed in the body and spaced axially from said plug means and having an opposite end axially extendable from the body;

recuperation means for opening fluid communication to the high pressure conduit from within said interior surface at a recuperation location disposed axially along the interior surface between said plug means and said one axial end of the plunger when fluid pressure at said location is greater than fluid pressure in said high pressure conduit, said recuperation means includes a recuperation passage extending radially through the body at said recuperation location and includes a recuperation check valve disposed in said recuperation passage for blocking fluid flow radially inwardly of the body through the recuperation passage and for passing fluid flow radially outwardly of the body through the recuperation passage; and passage means for providing fluid communication between said dual pressure conduit and said one axial end of the plunger, said passage means includes a closing passage extending radially through the body at a location spaced axially along said interior surface from the recuperation location toward said opposite end of the plunger, a closing check valve disposed in said closing passage for blocking fluid flow in a direction radially inwardly of the body through the closing passage and for passing fluid flow radially outwardly of the body through the closing passage, an opening passage extending radially through the body at a location spaced axially along said interior surface from the closing passage toward said opposite end of the plunger, an annular groove disposed exteriorly of the plunger for fluid communication with said opening passage at said interior surface of the body, a plunger conduit disposed in the plunger for fluid communication between said annular groove and said one axial end of the plunger, restrictor means disposed in said plunger conduit for restricting fluid flow in a direction from said one axial end toward said annular groove to a greater extent than said plunger conduit restricts fluid flow in a direction from said annular groove toward said one axial end, the dual pressure conduit communicates at said exterior surface of the body with said closing passage and with said opening passage.

2. The hydraulic valve actuator of claim 1 wherein said passage means comprises an orifice restricting fluid flow in a direction toward the dual pressure conduit.

3. The hydraulic valve actuator of claim 1 wherein:

the plunger moves in a direction toward said opposite axial end of the plunger to open the poppet valve when actuating fluid is provided at the dual pressure conduit from the high pressure source;

the dual pressure conduit is connected to the low pressure source to close the poppet valve, and the plunger moves in a direction toward said one axial end of the plunger as the poppet valve closes;

a quantity of said actuating fluid is disposed within said interior surface of the body at said one axial end of the plunger as the poppet valve closes; and as the poppet valve closes, kinetic energy of the poppet valve and the plunger generates a pressure in said quantity of said actuating fluid greater than the pressure of said actuating fluid at the high pressure conduit because said restrictor means is restricting fluid flow in a direction from said one axial end toward said annular groove, and said recuperation check valve is urged to open for fluid flow radially outwardly of the body through said recuperation passage to the high pressure conduit.

4. The hydraulic valve actuator of claim 3 wherein:

said opening passage is disposed axially along the plunger so that said opening passage communicates with said interior surface of the body at said one axial end of the plunger by way of said annular groove of the plunger and said plunger conduit to open the poppet valve when actuating fluid is provided at the dual pressure conduit from the high pressure source;

when actuating fluid is provided at the dual pressure conduit from the high pressure source to open the poppet valve, said closing check valve blocks flow of said actuating fluid flow through the closing passage;

when the dual pressure conduit is initially connected to the low pressure source to close the poppet valve, actuating fluid is disposed within said interior surface of the body at said one axial end of the plunger, and the closing check valve opens for flow of actuating fluid through the closing passage to the dual pressure conduit;

the plunger has a restrictor portion at said one axial end, said restrictor portion being configured so as to increasingly restrict fluid flow into said closing passage as the plunger moves in a direction toward said one axial end; and as the poppet valve closes, kinetic energy of the poppet valve and the plunger generates a pressure in said quantity of said actuating fluid greater than the pressure of said actuating fluid at the high pressure conduit because said restrictor portion is restricting fluid flow through said closing passage, and said recuperation check valve is urged to open for fluid flow radially outwardly of the body through said recuperation passage to the high pressure conduit.

* * * * *